United States Patent [19]

Thompson

[11] 3,979,938

[45] Sept. 14, 1976

[54] APPARATUS FOR BENDING THIN FLEXIBLE STRIPS

[75] Inventor: Clyde W. Thompson, Tulsa, Okla.

[73] Assignee: Carolea Wheeler, Tulsa, Okla.

[22] Filed: May 8, 1975

[21] Appl. No.: 575,626

[52] U.S. Cl. ..... 72/217; 72/321

[51] Int. Cl.[2] ..... B21D 7/03

[58] Field of Search ..... 72/217–219, 72/216, 149, 321

[56] References Cited

UNITED STATES PATENTS

| | | | |
|---|---|---|---|
| 2,234,170 | 3/1941 | Huck | 72/321 |
| 2,286,255 | 6/1942 | Brooks | 72/216 X |
| 2,414,926 | 1/1947 | Burke | 72/217 |

*Primary Examiner*—Milton S. Mehr

*Attorney, Agent, or Firm*—William S. Dorman

[57] ABSTRACT

Apparatus for bending a thin flexible and narrow strip having a flat longitudinally extending base portion and a central longitudinally extending rib projecting upwardly from the base portion at right angles thereto, the upper edge of the rib being sharpened, the strip being of the type adapted to be attached to a printing cylinder and used for perforating or shearing paper sheets being printed, the apparatus being adapted to bend the strip at right angles to the base portion thereof to form a predetermined geometric shape, such as a rectangular shape for cutting rectangular windows in the paper sheets. The apparatus comprises a stationary die mounted on a supporting base. The stationary die is provided with a recess at the lower portion thereof extending around the entire periphery and inwardly into the stationary die a distance slightly less than one-half of the width of the base portion of the strip. A movable die member having a forward flat edge parallel with and movable towards a rear flat edge on the stationary die is provided with a recess extending along a lower portion of the forward flat edge thereof and inwardly therein a distance slightly less than one-half the width of the base portion of the strip and being opposite to the recess in the rear edge of the stationary die. A pair of arms are pivotally connected to the supporting base below and adjacent the side edges of the stationary die, each arm having mounted thereon a slide member adapted to be moved towards and away from the stationary die. A rotatable wheel is rotatably mounted in each slide member on the side thereof towards the stationary die, each wheel having an annular recess therein extending inwardly into the wheel a distance slightly less than one-half of the width of the base portion of the strip, the recess of each wheel being opposite to or in alignment with the recess on the stationary die.

4 Claims, 6 Drawing Figures

APPARATUS FOR BENDING THIN FLEXIBLE STRIPS

BACKGROUND OF THE INVENTION

1. Field of the Invention

The present invention relates to an apparatus for bending a thin flexible and narrow strip. More particularly, the present invention relates to an apparatus for bending a thin flexible and narrow strip of the type used for perforating or shearing paper sheets being printed wherein the strip is bent into a predetermined geometric shape.

2. The Prior Art

The present invention relates to bending of thin flexible and narrow strips of the type shown in Bashaw U.S. Pat. No. 3,035,342 and, in particular, to the bending of the strip such as shown in FIG. 9 of the Bashaw patent. As also indicated in the Bashaw patent, there is a demand in the printing industry for extremely thin and flexible strip having a series of unstanding teeth, or a continuous tooth or rib, extending along a longitudinal line on one face thereof, the opposite face being flat. Such a strip is employed for perforating or shearing the paper sheets being printed, and must be sufficiently flexible to permit its being bent around the cylinder of an off-set press, and secured thereto by means of a suitable adhesive. In the past, these strips are generally placed on the cylinder of the off-set press so as to provide essentially linear perforated or shear lines on the paper sheets.

Prior to the present invention, the industry has recognized the desire to bend a strip into predetermined geometric shapes so that windows, for example, can be sheared or perforated into the paper strips; however, since the rib or tooth portion must still be at right angles to the paper sheets, the bending of the flexible strip will have to be at right angles to the base portion of the strip. Efforts to bend the strip into predetermined geometric shapes have been, largely, unsuccessful.

SUMMARY OF THE INVENTION

The present invention involves an apparatus for bending a thin flexible and narrow strip having a flat longitudinally extending base portion and a central longitudinally extending rib projecting upwardly from the base portion at right angles thereto, the upper portion of the strip being sharpened. The strip referred to herein is of the type adapted to be attached to a printing cylinder and used for perforating or shearing paper sheets being printed. The apparatus disclosed herein is adapted to bend the strip at right angles to the base portion thereof to form a predetermined geometric shape, such as a substantially rectangular shape for cutting rectangular windows in the paper sheets. More specifically, the apparatus of the present invention comprises a horizontally extending stationary die mounted on a supporting means or base. The stationary die is provided with a flat rear edge and an angular forward edge formed by a pair of inwardly and rearwardly converging front edge portions meeting substantially at the center of the front edge. The stationary die also includes a pair of inwardly and forwardly converging side edges which connect the outer ends of the rear edge with the outer ends of the front edge; the points of connection of the rear edge and the front edge with the side edge, however, are rounded. The stationary die is also provided with a recess extending around the lower portion thereof, the recess extending inwardly a distance slightly less than one-half of the width of the base portion of the strip. The apparatus also includes a movable die member having a forward flat edge parallel with and movable towards the rear flat edge of the stationary die, the movable die member being also provided with a recess extending along a lower portion of the forward flat edge thereof. The recess in the movable die also extends inwardly therein a distance slightly less than one-half the width of the base portion of the strip and, of course, it is opposite to the recess in the rear edge of the stationary die. Means are provided for moving the movable die towards the stationary die so as to grip or grasp a straight length of the strip therebetween. The rib portion of the strip is gripped between the forward flat edge of the movable die and the rear flat edge of the stationary die with the sides of the base portion of the strip being received in the opposed recesses in the stationary die and the movable die. A pair of arms are also provided pivotally connected to the supporting means below and adjacent the side edges of the stationary die. Each arm is provided with a slide member mounted thereon and adapted to be moved towards and away from the stationary die. Each slide member has rotatably mounted thereon a wheel which is provided with an annular recess extending inwardly into the wheel a distance slightly less than one-half of the width of the base portion of the strip. The recess in each wheel is opposite to the recess in the stationary die. Means are provided on each arm for urging its slide member towards the stationary die so that the wheel engages the strip held between the stationary die and the movable die and in such manner that the sides of the base portion of the strip are received in the opposed recesses in the wheel and the stationary die. Now, when the arms are rotated in a direction towards the forward edge of the stationary die, the strip will be bent first around the corners connecting the side edges of the stationary die with the rear edge thereof, then held against the side edges of the stationary die, and then bent around the corners connecting the side edges of the stationary die with the forward edges thereof. At this point, after the final bends are made in the strip, the ends of the strip will be somewhat overlapping; however, the ends of the strip are clipped off so that they will come together and form a rectangular window which can now be placed on the cylinder of an off-set press using suitable adhesive.

DESCRIPTION OF THE PREFERRED EMBODIMENTS

Figures 1, 2, 3, 4, 6:
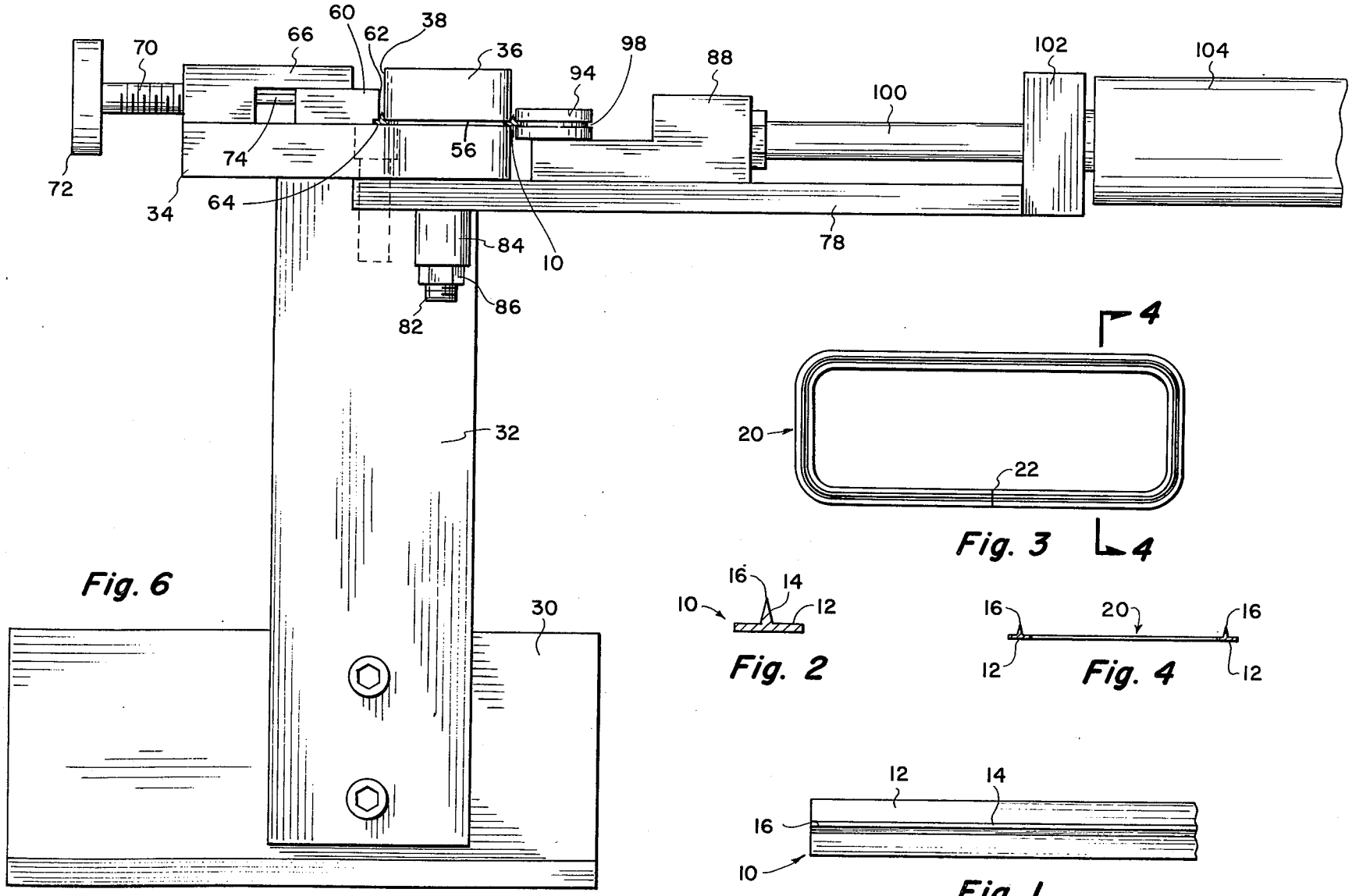
FIG. 1 is a plan view of a portion of a strip which is bent by the apparatus of the present invention.
FIG. 2 is a cross-sectional view of the strip shown in FIG. 1.
FIG. 3 is a plan view of a strip, such as shown in FIG. 1, after it has been bent into a predetermined rectangular shape by the apparatus of the present invention.
FIG. 4 is a sectional view taken along section line 4—4 of FIG. 3.
FIG. 6 is a side elevation of the bending apparatus shown in FIG. 5 with the slide arms being rotated 180°from the FIG. 5 position.

Referring to the drawings in detail, FIG. 1 shows a strip 10 generally similar to that shown in FIG. 9 of Bashaw U.S. Pat. No. 3,035,342. This strip includes a flat base portion 12 and a central rib or continuous tooth 14 having an upper sharpened edge 16. FIG. 3 shows the strip of FIG. 1 after it has been bent into the shape provided by the apparatus of the present invention; thus, this figure shows a rectangular shaped window 20 where the end portions mate together at 22. When the rectangular window 20 of FIG. 3 is placed on the cylinder of an off-set press, the upper sharpened edges 16 will provide a substantially rectangular cut on the sheets of paper passing through the press.

Figure 5:
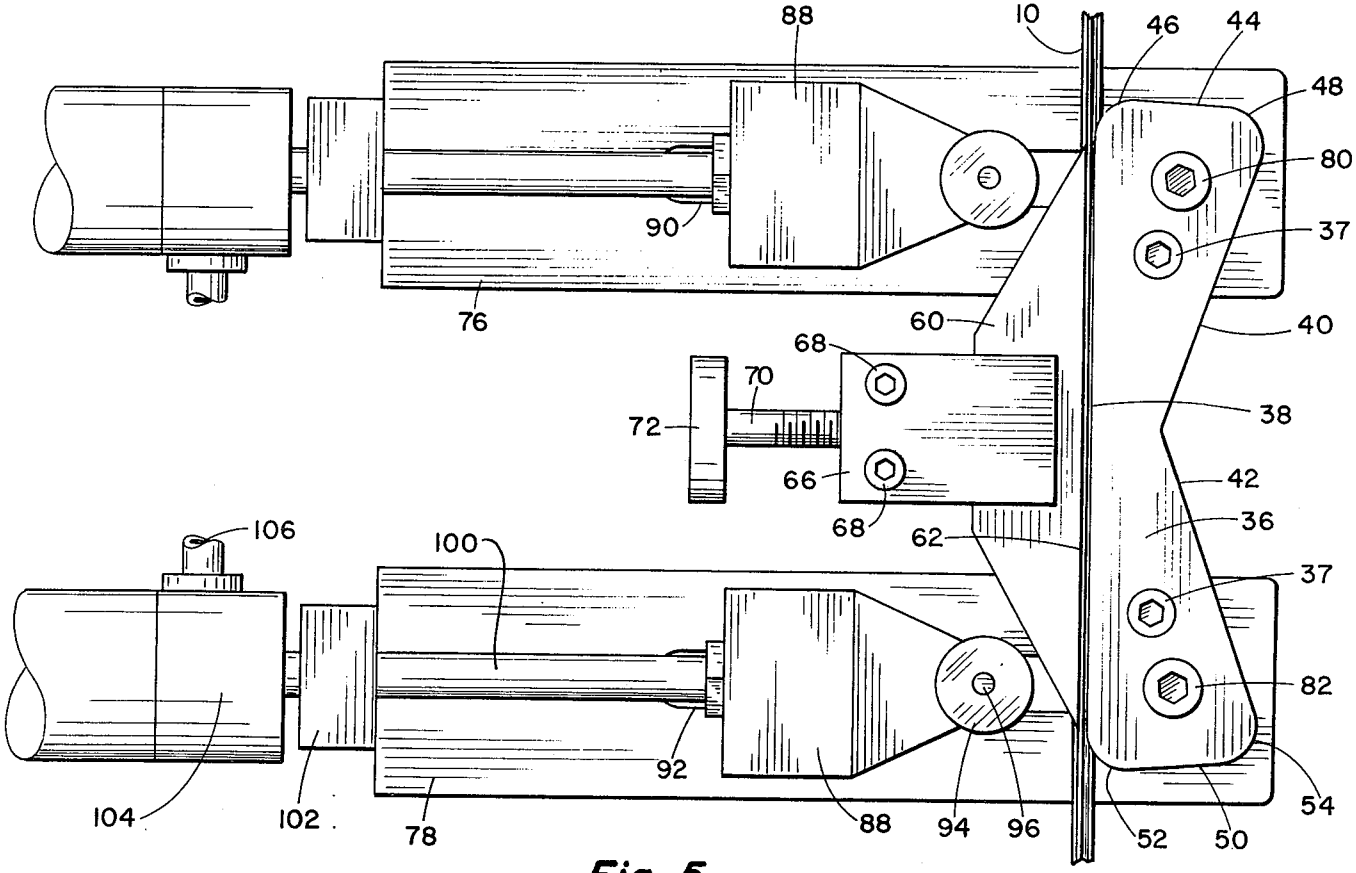
FIG. 5 is a plan view of the bending apparatus of the present invention.

Referring now to FIGS. 5 and 6, the apparatus of the present invention includes a lower base member 30 in the form of an angle member which can be conveniently bolted or clamped in any manner (not shown) to a bench (not shown) or other suitable location. A vertical plate or support 32 extends upwardly from the lower base member 30 and is welded or attached thereto by means of bolts, for example. An upper base 34 is suitably attached to the upper end of the vertical support 32. A stationary die 36 is conveniently attached to the right-hand end of the upper base 34 by means of screws 37, for example. The stationary die is generally shaped like a K which is closed at the top and bottom. Thus, the die is provided with a rear flat edge 38 and a forward flat edge comprised of flat edge portions 40 and 42 which converge inwardly and rearwardly, mating at the center of the forward edge of the stationary die 36. The shape of the stationary die 36 is completed by an upper edge 44 which connects the upper rear end of the rear edge 36 with the upper end of the inclined edge portion 42 forming rounded corners 46 and 48. The remaining edge 50 connects the lower end of the rear edge 38 with the lower end of the front edge portion 42, forming rounded corners 52 and 54. The lower portion of the stationary die 36 (see now FIG. 6) is provided with an indent or recess 56 which extends around the entire periphery of the stationary die 36. The reason why the upper base 34 does not appear in FIG. 5 is that the forward and side edges thereof conform exactly with the shape of the stationary die 36. The depth of the recess 56 is slightly less than one-half of the width of the base portion 12 of the strip 10.

A movable die 60 is slidably mounted on the upper base 34. This movable die has a forward flat edge 62 which is movable towards and adjacent the rear flat edge 38 of the stationary die 36. The movable die is provided with a recess 64 at the lower end of the flat edge 62. This recess also extends into the movable die 60 a distance slightly less than one-half of the width of the base portion 12 of the strip 10 and is in alignment with the recess 56 which extends around the stationary die 36.

A slide bracket 66 is suitably connected to the upper base 34 by means of screws 68, for example. A threaded rod 70 is suitably received in a threaded opening (not shown) in the slide bracket 60 and a round handle 72 is attached to the left-hand end of the rod 70 to permit the turning thereof. A stem 74 (see now FIG. 6) extends from the right-hand end of the threaded rod 70 and into engagement with the movable die 60 and connects with a suitable thrust bearing (not shown) in the movable die 60 so that turning of the rod 70 in one direction or the other will cause the movable die 60 to move towards or away from the stationary die 36.

A pair of arms 76 and 78 are pivotally connected to the upper base 34 below and adjacent the side edges 44 and 50, respectively, of the stationary die 36 by means of the screws 80 and 82, respectively, which are countersunk in the stationary die. A bushing or sleeve 84 is mounted on the screw 82 below the arm 78 and a nut 86 is received on the screw 82 below the bushing 84. A similar bushing and nut (not shown) are provided on the screw 80 below the arm 76. The above-described relationship permits the pivoting of the arms 76 and 78 from the position shown in FIG. 5 to the position shown in FIG. 6.

Two slide members, both designated by the reference character 88, are slidably received in suitable slots 90 and 92 of the arms 76 and 78, respectively. The details of the slide member 88 mounted on the arm 78 will now be described in greater detail, but it should be understood that the same considerations hold true for the slide member 88 which is mounted on the arm 76.

A wheel 94 is mounted on the forward end of each slide member 88 by means of a pin 96. Each wheel 94 is provided with a groove or recess 98 which is opposite to the groove or recess 56 in the stationary die 36. This recess 98 extends into the wheel 94 a distance slightly less than one-half of the width of the base portion of the strip 10. A piston rod 100 engages the side of the slide 88 oppposite from the wheel 94 for moving the slide towards and away from the stationary die 36. The opposite end of the piston rod 100 passes through a vertical portion 102 of the arm 78 and into a hydraulic or pneumatic cylinder 104, the power to which is supplied through a conduit or connection 106. Thus, when the cylinder 104 is provided with hydraulic or pneumatic pressure through the line 106, the piston rod 100 will urge the slide 88 and hence the wheel 94 towards the stationary die 36.

Operation

To produce the rectangular shape shown in FIGS. 3 and 4, the apparatus shown in FIGS. 5 and 6 is first opened up by moving the movable die 60 towards the left (see FIG. 5) and away from the stationary die 36 a sufficient distance so that a length of the strip 10 can be inserted between the fixed die and the movable die. A sufficient length of the strip 10 (readily determined by trial and error) is now placed in position between the fixed die 36 and the movable die 60 so that the rib 14 projects upwardly into the space between the two die members. The ends of the strip will project outwardly from the apparatus on both sides thereof substantially the same distance. Now the movable die 60 is moved into clamping position by turning the knob 72. The die 60 is moved towards the fixed die 36 until the rib 14 is grasped between the flat surfaces 62 and 38, the sides of the base portion 12 of the strip 10 being received in the recesses 56 and 64.

At this point, the slide members 88 can be actuated simultaneously or independently. Considering, first of all, the slide member 88 mounted on the arm 78, pressure is supplied to the cylinder 104 through the connection 106 and the piston rod 100 will urge the slide member 88 and hence the wheel 94 towards the stationary die 36 until the wheel 94 engages the strip 10 held between the stationary die 36 and the movable die 60. The side edge of the roller will contact the rib portion 14 and the side of the base portion 12 away from the stationary die 36 will be received in the recess 98 in the wheel 94. With pressure being applied continuously to the wheel 94 through the piston rod 100, the arm 78 can now be rotated in a counter-clockwise direction (with respect to FIG. 5). The strip 10 will first be bent around the corner 52, then held against the side 50, then bent around the corner 54, and then bent somewhat along the edge 42. The slide 88 on the arm 76 can be operated in similar fashion by rotating the same in a clockwise direction (with respect to FIG. 5) and the strip 10 will be bent around the corner 46, held against the side 44, bent around the corner 48, and then held against the side portion 40 for some slight distance after bending around the corner 48. At this point the pressure can be removed from the piston rods and the resulting overlapping ends of the strip can be clipped or cut so that they will come together at 22. The movable die 60 is moved in reverse direction so that the resulting rectangular shape can be removed from the apparatus.

It should be noted that the sides 44 and 50 (with respect to FIG. 5) are tapered inwardly and forwardly. Stated differently, the corners 46 and 52 are slightly less then 90° so that the strip 10, in bending around these corners, will be bent more than 90°. The reason for this is that the strip 10, in being bent, has a tendency to return somewhat to its original position. Thus, if the strip 10 is bent through an angle of more than 90°, it has been found that it will spring back to about 90°. The same considerations hold true for the corners 48 and 54.

Whereas the present invention has been described in particular relation to the drawings attached hereto, itt should be understood that other and further modifications, apart from those shown or suggested herein, may be made within the spirit and scope of this invention.

I claim:

1. Apparatus for bending a thin flexible and narrow strip having a flat longitudinally extending base portion and a central longitudinally extending rib projecting upwardly from the base portion at right angles thereto, the upper edge of said rib being sharpened, said strip being of the type adapted to be attached to a printing cylinder and used for perforating or shearing paper sheets being printed, said apparatus being adapted to bend said strip at right angles to the base portion thereof to form a predetermined geometric shape for cutting said geometric shape in said paper sheets; comprising a horizontally extending stationary die mounted on a supporting means; said stationary die having a continuous vertical edge conforming generally to said geometric shape and having a recess extending around a lower portion thereof, said recess extending inwardly into said stationary die a distance slightly less than one-half of the width of the base portion of said strip; a movable die member having an edge portion parallel with and movable towards a complementary shaped edge portion of said stationary die, said movable die member having a recess extending along a lower portion of the edge portion thereof, the recess in said movable die extending inwardly therein a distance slightly less than one-half of the width of the base portion of said strip and being opposite to the recess in the complementary portion of said stationary die; means for moving said movable die towards said stationary die so as to grasp a length of said strip therebetween with the rib portion thereof being gripped between the edge portion of the movable die and complementary portion of the stationary die and with the sides of the base portion thereof being received in the opposed recesses in the stationary die and the movable die; slide support means pivotally connected to the supporting means, said slide support means having mounted thereon a slide member adapted to be moved towards and away from said stationary die; a rotatable wheel rotatably mounted in said slide member on the side thereof towards said stationary die, said wheel having an annular recess therein extending inwardly into the wheel a distance slightly less than one-half the width of the base portion of said strip, the recess in said wheel being in alignment with the recess in said stationary die; means mounted on said slide support means for urging said slide member towards said stationary die so as to engage said wheel with the strip held between the stationary die and the movable die, the sides of the base portion of said strip being received in the opposed recesses in said wheel and said stationary die, whereby, when said slide support means is rotated around said stationary die, said strip will be bent around the vertical edge of the stationary die to form said predetermined geometric shape.

2. Apparatus for bending a thin flexible and narrow strip as set forth in claim 1 wherein the continuous vertical edge on said stationary die is formed by a flat rear edge, an angular forward edge formed by a pair of inwardly and rearwardly converging front end edge portions meeting substantially at the center of said front edge, and a pair of inwardly and forwardly converging side edges connecting the outer ends of the rear edge with the outer ends of the front edge, the points of connection of the rear edge and the front edge with the side edges being rounded; the edge portion on said movable die member being flat and parallel with the flat rear edge on said stationary die.

3. Apparatus for bending a thin flexible and narrow strip having a flat longitudinally extending base portion and a central longitudinally extending rib projecting upwardly from the base portion at right angles thereto, the upper edge of said rib being sharpened, said strip being of the type adapted to be attached to a printing cylinder and used for perforating or shearing paper sheets being printed, said apparatus being adapted to bend said strip at right angles to the base portion thereof to form a substantially rectangular shape for cutting rectangular windows in said paper sheets; comprising a horizontally extending stationary die mounted on a supporting means; said stationary die having a flat rear edge, an angular forward edge formed by a pair of inwardly and rearwardly converging front edge portions meeting substantially at the center of said front edge, and a pair of inwardly and forwardly converging side edges connecting the outer ends of the rear edge with the outer ends of the front edge, the points of connection of the rear edge and the front edge with the side edges being rounded, said stationary die having a recess extending around a lower portion thereof, said recess extending inwardly a distance slightly less than one-half of the width of the base portion of said stip; a movable die member having a forward flat edge parallel with and movable towards the rear flat edge of said stationary die, said movable die member having a recess extending along a lower portion of the forward flat edge thereof, the recess in said movable die extending inwardly therein a distance slightly less than one-half of the width of the base portion of said strip and being opposite to the recess in the rear edge of said stationary die; means for moving said movable die towards said stationary die so as to grasp a straight length of said strip therebetween with the rib portion thereof being gripped between the forward flat edge of the movable die and rear flat edge of the stationary die and with the sides of the base portion thereof being received in opposed recesses in the stationary die and the movable die; a pair of arms pivotally connected to the supporting means below and adjacent the side edges of said stationary die, each arm having mounted thereon a slide member adapted to be moved towards and away from said stationary die, a rotatable wheel rotatably mounted in each slide member on the side thereof towards said stationary die, each wheel having an annular recess therein extending inwardly into the wheel a distance slightly less than one-half of the width of the base portion of said strip, the recess in each wheel being in alignment with the recess in said stationary die;

means mounted on each arm for urging its slide member towards said stationary die so as to engage each wheel with the strip held between the stationary die and the movable die, the sides of the base portion of said strip being received in the opposed recesses in each wheel and said stationary die, whereby, when said arms are rotated in a direction towards the forward edge of said stationary die, said strip will be bent first around the corners connecting the side edges of the stationary die with the rear edge thereof then compressed along the side edges of said stationary die, then bent around the corners connecting the side edges of the stationary die with the forward edges of the stationary die.

4. Apparatus for bending a thin flexible and narrow strip as set forth in claim 3 wherein the angles at the corners of the stationary die are such that the strip will be bent through more 90° in going around each corner.

* * * * *